US011828049B2

(12) United States Patent
Wölfler et al.

(10) Patent No.: US 11,828,049 B2
(45) Date of Patent: Nov. 28, 2023

(54) SINK WITH A MOVABLE INSERT PLATE AND ACTIVE DISCHARGE DEVICE FOR RESIDUAL MEDIA ON THE INSERT PLATE

(71) Applicant: BSH Hausgeräte GmbH, Munich (DE)

(72) Inventors: Andreas Wölfler, Saalfelden (AT); Benjamin Reu, Prien am Chiemsee (DE); Ingo Abels, Siegsdorf (DE)

(73) Assignee: BSH Hausgeräte GmbH, Munich (DE)

( * ) Notice: Subject to any disclaimer, the term of this patent is extended or adjusted under 35 U.S.C. 154(b) by 0 days.

(21) Appl. No.: 17/776,656

(22) PCT Filed: Nov. 11, 2020

(86) PCT No.: PCT/EP2020/081727
§ 371 (c)(1),
(2) Date: May 13, 2022

(87) PCT Pub. No.: WO2021/104869
PCT Pub. Date: Jun. 3, 2021

(65) Prior Publication Data

US 2022/0396938 A1 Dec. 15, 2022

(30) Foreign Application Priority Data

Nov. 29, 2019 (DE) ..... 102019218650.5

(51) Int. Cl.
*E03C 1/186* (2019.01)

(52) U.S. Cl.
CPC ..... *E03C 1/186* (2013.01)

(58) Field of Classification Search
CPC ..... E03C 1/186; A47J 47/20
See application file for complete search history.

(56) References Cited

U.S. PATENT DOCUMENTS 2,197,178 A * 4/1940 Gilbert ..... A47L 19/00 392/382
3,346,886 A * 10/1967 Kashiwamura ..... E03C 1/186 108/134
3,882,553 A 5/1975 Poiencot
4,336,620 A * 6/1982 Gresh ..... A47J 47/20 4/651

(Continued)

FOREIGN PATENT DOCUMENTS

CN 106579805 A 4/2017
CN 206090741 U 4/2017
CN 109695275 A * 4/2019

(Continued)

OTHER PUBLICATIONS

National Search Report DE 2019218650.5 dated Apr. 10, 2020.
International Search Report PCT/EP2020/081727dated Jan. 22, 2021.

*Primary Examiner* — Erin Deery
(74) *Attorney, Agent, or Firm* — Michael E. Tschupp; Andre Pallapies; Brandon G. Braun

(57) ABSTRACT

A sink includes a basin which includes a base wall and lateral walls adjoining the base wall. The basin includes a receiving area which is delimited by the base wall and the lateral walls. An insert plate separate from the basin is inserted into the receiving area, and moved by a lifting device relative to the basin. A residual media discharge device discharges residual media from a top of the insert plate.

20 Claims, 2 Drawing Sheets

(56) References Cited

U.S. PATENT DOCUMENTS

2005/0067747 A1 3/2005 Erickson

FOREIGN PATENT DOCUMENTS

| | | | | | |
|---|---|---|---|---|---|
| CN | 109695275 | A | | 4/2019 | |
| DE | 3621151 | A1 | | 1/1988 | |
| DE | 202010007075 | U1 | * | 11/2010 | ..... A47K 1/04 |
| WO | WO-2012033350 | A2 | * | 3/2012 | ..... A47L 15/0086 |

* cited by examiner

SINK WITH A MOVABLE INSERT PLATE AND ACTIVE DISCHARGE DEVICE FOR RESIDUAL MEDIA ON THE INSERT PLATE

CROSS-REFERENCES TO RELATED APPLICATIONS

This application is the U.S. National Stage of International Application No. PCT/EP2020/081727, filed Nov. 11, 2020, which designated the United States and has been published as International Publication No. WO 2021/104869 A1 and which claims the priority of German Patent Application, Serial No. 10 2019 218 650.5, filed Nov. 29, 2019, pursuant to 35 U.S.C. 119(a)-(d).

The contents of International Application No. PCT/EP2020/081727 and German Patent Application, Serial No. 10 2019 218 650.5 are incorporated herein by reference in their entireties as if fully set forth herein.

BACKGROUND OF THE INVENTION

One aspect of the invention relates to a sink with a basin. The basin has a base wall and lateral walls adjoining the base wall. The basin has a receiving area delimited by the walls. Moreover, the sink has an insert plate which is separate from the basin and which is inserted into the receiving area.

Such sinks are known. Thus a sink which has a basin is disclosed, for example, in US 2005/0067747 A1. A base which is configured in one piece with the basin bottom and which extends upwardly is configured on the basin bottom. A plate may be attached to this base. As a result, a cutting board is formed on which objects, such as food, may be chopped. Such an embodiment is disadvantageous in that the integrated base is always present and thus a basic embodiment of the basin is complex in terms of shape and is configured such that the receiving area is restricted over the periphery. Moreover, it is always the case that the plate which is able to be positioned on the base is arranged only at one height level. The plate is only able to be positioned or removed by a user.

A sink is also disclosed in DE 362 1151 A1. Various inserts which may be inserted into the receiving area are provided separately from the basin. The inserts may be plates or further basin-like containers. These inserts may be positioned on the upper edge of the basin. The usability of a sink is also significantly restricted thereby and the inserts have to be attached or removed by a user, and it is always the case that the inserts are able to be positioned only at one individual position.

BRIEF SUMMARY OF THE INVENTION

It is the object of the present invention to provide a sink with a basin and a separate insert plate, in which the insert plate is able to be kept clean.

This object is achieved by a sink as claimed in claim 1.

One aspect of the invention relates to a sink with a basin. The basin has a base wall and lateral walls adjoining the base wall. The basin also has a receiving area delimited by the base wall and the lateral walls. The receiving area is open at the top. The sink has an insert unit, in particular an insert plate, in particular a contiguous and non-perforated insert plate, which is separate from the basin. This insert plate is able to be inserted into the receiving area or is inserted therein. The sink also has a lifting device, by means of which the insert plate can be moved relative to the basin in the vertical direction of the sink. This is made possible by a physical lifting device of the sink. Thus a sink is provided in which in principle the possibility is provided to arrange the insert unit at different vertical positions. This is also made possible by a lifting device and does not have to be carried out manually by the user himself. In principle, it is possible that a continuous vertical adjustment of the insert plate is made possible by the lifting device. Thus it is possible to approach and set many different height levels of the insert plate.

The sink also has an active residual media discharge device. The discharge of residual media from the top of the insert plate may be carried out by the residual media discharge device. The residual media discharge is, in particular, a physical device which is constructed from functional components. By means of this embodiment it is possible to keep the insert plate clean, in particular on the top thereof. Appropriate cleaning is also made possible thereby. In particular, as a result it is possible to avoid the situation where residual media collect on the top. In principle, residual media are understood to mean media which may be deposited for a lengthy period of time on the top of the insert plate. For example, this may be liquid which might remain on the top of the insert plate and not drain away. Other solid media may also be understood to be such residual media.

In particular, it is provided that the residual media discharge device has a movement unit. The movement unit is configured to move the insert plate in a defined manner for the discharge of the residual media. Thus the sink may be operated individually in a discharge mode. In the discharge mode, which is different in comparison with the normal mode of the sink, therefore, a discharge process of residual media is carried out on the top of the insert plate. In this embodiment, therefore, it is provided that a discharge of residual media is carried out by a separate movement of the insert plate. In particular, a specific defined discharge movement of the insert plate may be brought about to this end. This is carried out, in particular, by the physical movement unit of the sink. By means of this embodiment, an extensive and appropriate discharge of residual media may be carried out.

Preferably, this defined discharge movement of the insert plate is such that the residual media pass into the receiving area of the basin and may be transported away therefrom via an outlet opening. Thus when this discharge of the residual media is carried out in a defined manner it is possible to avoid the situation where the residual media pass out of the basin and, for example, pass onto an adjacent worktop.

In a further embodiment it may be provided that a movement of the insert plate which is initiated by the movement unit for the discharge of residual media is a tilting movement of the insert plate. In particular, therefore, such a movement is a tilting movement relative to a horizontal plane. Additionally or alternatively, such a movement of the insert plate for the discharge of residual media may be a rotation about a vertical axis. The drainage of liquid media from the top of the insert plate may be achieved in a very advantageous manner by the tilting movement. Thus a defined tilted position is set, said position permitting a correspondingly metered drainage of this residual media. Particularly advantageously, therefore, the drainage into the receiving area itself may be carried out in this discharge mode and in the set tilted position. Thus an automatic drainage of the residual medium contained in the receiving area may also be carried out via a drainage opening in the basin. Thus such a removal of the residual media from the top of the insert plate may be carried out virtually without any direct intervention by the user on the top of the insert plate. For example, a specific wiping with a cloth or the like no longer has to be carried out.

With a rotation carried out separately or in combination with the tilting movement, residual media may also be correspondingly thrown down from the top of the insert plate. Preferably, during a rotation, the insert plate may be brought into an at least partially downwardly moved position. This means that the insert plate is not arranged in the maximum upper vertical position thereof. It is achieved by such an at least partially lowered position that the top of the insert plate is arranged below an upper edge of the basin, when viewed in the vertical direction. Residual media which have been thrown off as a result of the rotation are thus in any case thrown onto the inner faces of the vertical lateral walls of the basin and not thrown out of the basin. If the rotation is simply carried out at a reduced speed, then it is also possible that the residual media may be brought to the edge of the insert plate in a very metered manner and, without being forcibly thrown onto the lateral walls, discharged therefrom downwardly into the receiving area of the base wall. A combined tilting movement and rotational movement may also be carried out as a discharge movement for the discharge of the residual media from the top of the insert plate. In an advantageous embodiment this also results in a wobbling movement.

It may be provided that this discharge mode is controlled by a control unit of the sink. Thus both the duration and the type of movement of the insert plate for the discharge of the residual media may be individually set. For example, therefore, it is possible to start with a rotational movement and then a tilting movement may be carried out as a subsequent movement. It is also possible to start with a tilting movement and then subsequently a rotational movement may be carried out. A tilting and rotational movement may also be carried out at the same time. It is also possible that the set tilted position is changed in the discharge mode, in order to be able to achieve a more or less forceful discharge of the residual media from the top. Additionally or alternatively, for example, the rotational speed of the insert plate may also be changed during the discharge process. This may be carried out, for example, in a generalized manner by a predetermined program during the discharge process. However, it may also be provided that the sink has at least one sensor which detects the top of the insert plate. Thus the discharge process may be individually set as a function of this detected information. Additionally or alternatively, it may then be provided that the discharge process is individually changed during the implementation thereof, in particular as a function of the information detected by the sensor.

In an advantageous embodiment it may be provided that the residual media discharge device has at least one airflow generation unit of the sink. A defined airflow may be generated by means of this airflow generation unit for flowing onto the top of the insert plate. In particular, it is possible thereby to achieve a contactless discharge of the residual media from the top. Such an airflow may be individually set relative to the intensity of the airflow and also relative to the orientation.

In a further advantageous embodiment it may be provided that the residual media discharge device has a slide. This slide may be slidable over the top of the insert plate for the discharge of residual media. In particular, the sink may have a motor, this slide being driven thereby. This slide may be displaceable in a linear manner. Additionally or alternatively, the slide may also be set in rotation and thus rotated.

In a further advantageous embodiment it is provided that the residual media discharge device has a movable flap or a slide which releases or blocks a discharge conduit in the insert plate for the discharge of residual media from the top via the discharge conduit. As a result, such a residual media discharge device may be configured so as to be integrated in the insert plate itself. By the integrated discharge conduit, the residual medium may be initially collected in a targeted and directed manner and then discharged in a targeted manner from the top of the insert plate via the discharge conduit. Due to the flap or the slide, the discharge conduit is not continuously open. As a result, on the one hand, a smooth and flat top may be provided and the discharge conduit correspondingly opened in an appropriate manner. In particular, this may be the case in the discharge mode of the sink. The flap or the slide may be mechanically actuated. In particular, this may be carried out directly by a user. However, it may also be provided that this flap or the slide is controlled, opened or closed by a control unit.

It may also be provided that the residual media discharge device has a vibration unit. The insert plate is able to be set in vibration by means of this vibration unit. A discharge of residual media from the top may also be appropriately carried out thereby.

In particular, it may also be provided that the residual media discharge device has a deformation unit. By means of this deformation unit, the top of the insert plate is elastically deformable in a temporarily defined manner for the discharge of residual media. For example, this may be carried out in a targeted manner in a discharge mode of the sink. By means of the deformation unit, the insert plate may be brought via the normal mode into a defined shape in the discharge mode in which a discharge of residual media is appropriately carried out in a directed manner from the top. This is advantageous if at least the top of the insert plate is elastically deformable in this regard.

It may be provided that the deformation unit has at least one movable punch. This punch may act on the insert plate for the defined deformation thereof. For example, the punch may be a pressure punch which presses onto the insert plate in order to generate a corresponding deformation. However, it may also be a suction punch which pulls from below on the insert plate. The punch may be a mechanically operating punch or a hydraulically operating punch or an electromechanically operating punch. The punch may operate in a controlled manner via a control unit of the sink. In particular, an elastic deformation, for example an upward bulging, is provided so that the insert plate has a dome-like top. Thus residual media may be uniformly discharged in all directions. However, it is also possible that a deformation occurs locally so that, for example, a channel-like recess is generated.

In an advantageous embodiment it is provided that the residual media discharge device has an electromechanical device. This electromechanical device may be controlled via a control unit of the sink.

In particular, a plate receiver for the insert plate is configured on the upper region of the upper lifting segment. For example, this plate receiver may be implemented as an injection-molded component, in particular as a 2K injection-molded component. It may be provided that at least one through-hole is located in this plate receiver. An actuating element may extend through this through-hole from below, a support vane positioned on the plate receiver being able to be lifted thereby. In particular, a pivoting about a horizontal pivot axis may be implemented by this lifting so that a support vane may be positioned obliquely and thus in a tilted manner. Preferably, such a hole or a feedthrough in the plate receiver is covered in the upper region by a resilient component. As a result, it is possible to avoid the situation where media could pass from above into this hole in the plate receiver. Since this cover is configured in a resilient manner, the actuating element may act on this resilient element and bulge it upwardly. Thus a corresponding actuating force may also be transmitted to the support vane and this support vane may be tilted.

In an advantageous embodiment it is provided that a top of the insert plate has a surface which is at least 80 percent, in particular at least 90 percent, in particular at least 95 percent, of the surface of the receiving area in a horizontal plane. The surface of the top of the insert plate, however, is less than 99 percent of this surface of the receiving area. By such a dimensioning, the insert plate is configured over virtually the entire surface area relative to the clear width of the receiving area between the lateral walls, and thus fills up this receiving area virtually entirely when viewed in the horizontal plane. On the other hand, however, a small gap, in particular of between 3 mm and 15 mm, in particular of between 3 mm and 10 mm, is permitted over the periphery so that, on the one hand, the relative movement of the insert plate may be carried out unhindered when setting the position or changing the position. In particular, as a result, this avoids direct contact and a side edge of the insert plate potentially scraping along the inner faces of the lateral walls. Thus, on the one hand, damage to the lateral walls is avoided and, on the other hand, damage to the insert plate and also to the lifting device is avoided. Last but not least, it is also advantageously achieved by this embodiment that liquid which is present on the top of the insert plate may be drained in a simple manner into the receiving area through this gap between the edge of the insert plate and the inner faces of the lateral walls.

Preferably, the basin has a drain, in particular on the base wall. As a result, a medium which is arranged in the basin and collects therein may drain out easily via the drain.

In particular, the basin is configured in one piece with the base wall and the lateral walls. In particular, the basin is configured from metal.

The base wall may be flat or slightly inclined or slightly bulged. In particular, it is provided that the point of the base wall at which an outlet for a drain of the sink is configured is offset furthest toward the bottom relative to the vertical position.

It may be provided that the top of the plate is configured to be entirely flat. However, the top may also be slightly bulged. It is also possible that the top of the insert plate is structured at least in some regions. As a result, a certain roughness may be generated. As a result, it is possible to avoid in an improved manner undesired slippage of objects positioned thereon. For example, this is advantageous when a change in the position of the insert plate occurs and objects are still arranged on the top of the insert plate. It is also possible that the top has specific positioning regions. These positioning regions may be recesses. However, such recesses may be configured to be relatively small, for example. This is advantageous in order to be able to position, for example, vessels such as a glass or the like more securely. In particular, this is advantageous when a change in the position is tilting and/or rotating. An undesired slippage of such vessels is thus avoided. Moreover, it is also achieved by such predetermined positioning regions, for example, that when vessels are positioned on the top of the insert plate and, for example, are designed to be filled via the faucet, the water running out of the faucet flows accurately into the vessels with a rotational movement and does not run over the circumference of the vessels onto the insert plate.

The lifting device may have a lifting unit and a motor. The lifting unit may be moved by the motor at least in the vertical direction.

The positions and orientations provided when the sink is used as intended and arranged as intended are specified by the terms "top", "bottom", "front" "rear" "horizontal", "vertical", "depth direction", "width direction", "vertical direction".

Further features of the invention emerge from the claims, the figures and the description of the figures. The features and combinations of features mentioned above in the description, as well as the features and combinations of features mentioned below in the description of the figures and/or shown individually in the figures are not only able to be used in the respectively specified combination but also in other combinations or individually without departing from the scope of the invention. Thus embodiments of the invention which are not explicitly shown and described in the figures but which emerge from and which may be generated by separate combinations of features from the described embodiments are also to be regarded as encompassed and disclosed. Embodiments and combinations of features which thus do not have all of the features of an originally formulated independent claim are also to be regarded as disclosed.

BRIEF DESCRIPTION OF THE DRAWINGS

Exemplary embodiments of the invention are described hereinafter in more detail with reference to schematic drawings. In the drawings.

DETAILED DESCRIPTION OF EXEMPLARY EMBODIMENTS OF THE PRESENT INVENTION

Figure 1:
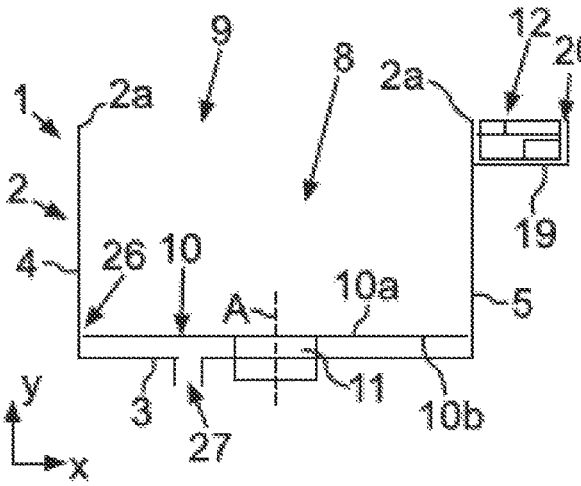
FIG. 1 shows a schematic sectional view through an exemplary embodiment of a sink according to the invention with an insert plate in a first position.

Elements which are the same or functionally the same are provided with the same reference characters in the figures.

Figure 3:
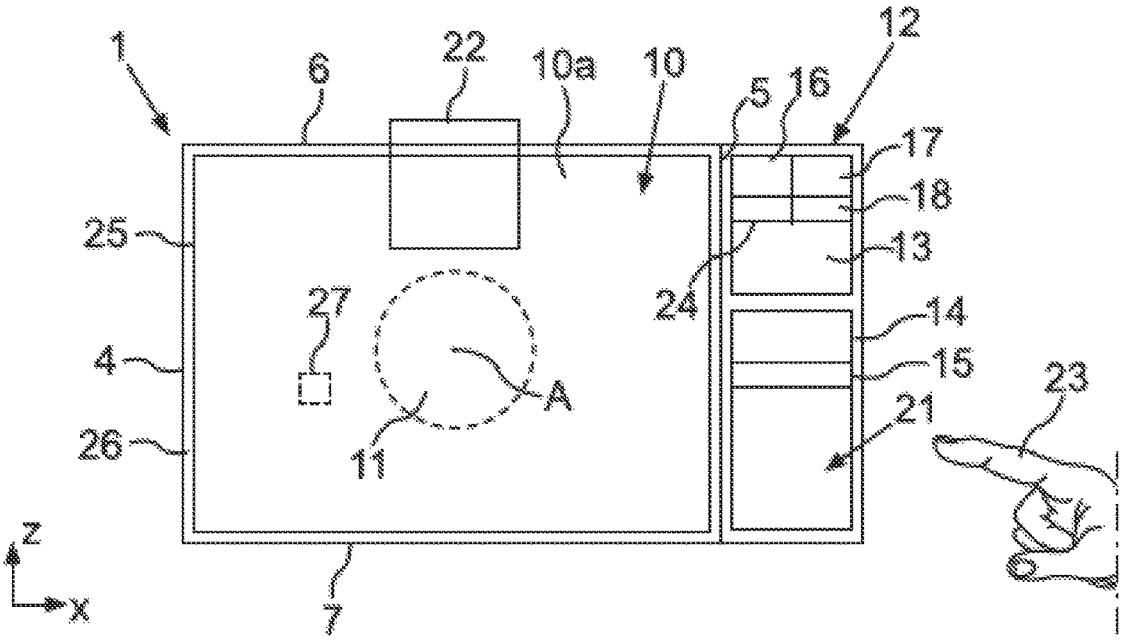
FIG. 3 shows a plan view of an exemplary embodiment of a sink.

A sink 1 is shown in FIG. 1 in a schematic vertical sectional view (x-y plane with the vertical direction y and width direction x). The sink 1 has a basin 2. The basin 2 has a base wall 3 and adjoining and upwardly extending lateral walls 4, 5, 6 (FIG. 3) and 7 (FIG. 3). The basin 2 is configured, in particular, in one piece. The basin is preferably configured from metal. The basin 2 has a receiving area 8. The receiving area 8 is delimited by the aforementioned walls 3 to 7. Thus the basin 2 has an upper loading opening 9. The sink 1 also has an insert unit. The insert unit is, in particular, an insert plate 10. The insert plate 10 is configured, in particular, in one piece. The insert plate 10 is a component of the sink 1 which is separate from the basin 2. The sink 1 also has a lifting device 11. The insert plate 10 is arranged on the lifting device 11. In particular, the insert plate is arranged on the lifting device 11 such that it can be released in a non-destructive manner. The insert plate 10 is movable relative to the basin 2 by the lifting device 11. In this context, a movement may take place in the vertical direction (y-direction) of the sink 1. Additionally or alternatively, a rotation may take place about a vertical axis A of the lifting device 11. Additionally or alternatively, a tilting of the insert plate 10 may take place. This means that the insert plate 10 may be set with its plane at an angle to a horizontal plane. It may thus be positioned in an inclined or oblique manner. In FIG. 1 the insert plate 10 is shown in an exemplary position in the receiving area 8. In particular, this is a position which has been moved downwardly. In this regard, the insert plate 10 is arranged directly adjacent to the base wall 3.

Preferably, the sink 1 has an interaction unit 12. The interaction unit 12 may have a display unit 13 (FIG. 3). The interaction unit 12 may have an operating device 14. The operating device 14 may have one or more operating elements. The operating elements may be push buttons or switches or toggle elements or rotary knobs. The operating device 14, however, may also additionally or alternatively have a touch-sensitive operating panel 15. In an advantageous embodiment it may be provided that the interaction unit 12 has at least one optical detection unit 16. The optical detection unit 16 may be, for example, a camera. The camera may be sensitive in the spectral range visible to humans. The interaction unit 12, however, may also additionally or alternatively have an acoustic unit 17. This acoustic unit 17 may be configured for the reception and/or for the output of speech signals. Moreover, the interaction unit 12 may have an identification unit 18. The identification unit 18 is configured for identifying, or for the identification of, a user of the sink 1. The identification unit 18 may also be formed, for example, by the optical detection unit 16. Additionally or alternatively, however, the identification unit 18 may also have, for example, the acoustic unit 17. As a result, for example, the user may be identified by the evaluation of a speech signal of a user. Additionally or alternatively, the identification unit 18 may be configured as a unit for detecting and evaluating a biometric feature of a user. For example, this may be a fingerprint sensor or a sensor for identifying an iris pattern.

Figure 2:
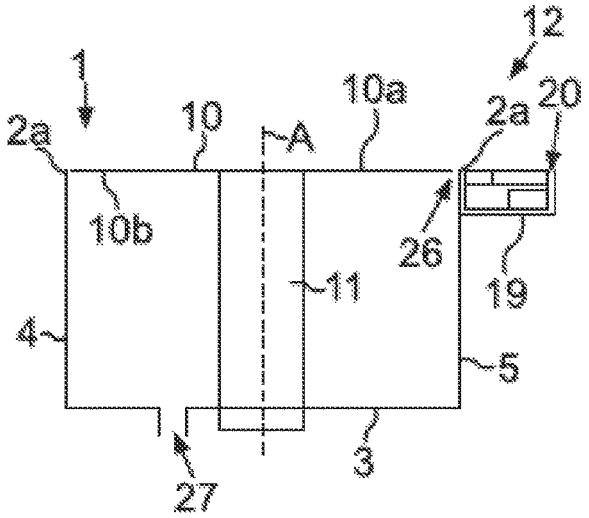
FIG. 2 shows the view of the sink according to FIG. 2 with the insert plate in a second position which is different from FIG. 1.

As may be identified in FIGS. 1 to 3, the interaction unit 12 may be configured at the side and directly adjacent to the basin 2. For example, a receiving housing 19 which is open at the top may be provided here. The receiving housing 19 may be configured separately from the basin 2. However, the receiving housing may also be formed with the basin 2 such that it cannot be released in a non-destructive manner. In particular, the receiving housing 19 may also be configured in one piece with the basin 2. The lateral wall directly adjoining the receiving housing 19, in the example here the lateral wall 5, also forms a defining wall for the receiving volume 20 of the receiving housing 19.

Thus the receiving volume 20 is separated from the receiving area 8 of the basin.

In FIG. 2 the view according to FIG. 1 is shown, but the insert plate 10 is shown in a different position from FIG. 1. In FIG. 2 the insert plate 10 is oriented horizontally but moved upwardly. In particular, this position represents the maximum possible vertical position in normal mode. In particular, in this position a top 10*a* of the insert plate 10 is flush with an upper edge 2*a* of the basin 2. In particular, in this position, the insert plate 10 forms a cover or a lid for the receiving area 8. This upper edge 2*a*, however, may also be for example a top of a mounting frame or a decorative frame which is a constituent part of the sink 1. The sink 1, in particular the basin 2, may be mounted with the mounting frame in a cutout of a worktop. The basin 2 may be covered from above with a decorative frame. A gap between the basin 2 and a defining wall in the worktop, which defines the cutout, thus may be covered from above. Such a decorative frame, in particular, represents an upper visible component of the arrangement.

In particular, the sink 1 also has a control unit 21 (FIG. 3). The lifting device 11 may be operated by the control unit 21. In particular, the interaction unit 12 may also be operated by the control unit 21.

The sink 1 may preferably also have a faucet 22, as may be identified in the simplified plan view in FIG. 3. The faucet 22 represents a functional unit of the sink 1. The interaction unit 12, in particular the operating device 14, may also be viewed as a functional unit of the sink 1. A further functional unit of the sink 1 may be the insert plate 10. A further functional unit of the sink 1 may be the lifting device 11.

The lifting device 11 preferably has a lifting unit and a motor. As a result, the lifting device may be changed in terms of its length or height in the direction of the vertical axis A. Moreover, the lifting device may be additionally or alternatively rotated about the vertical axis A. As a result, a rotational movement about this vertical axis A is also possible as a position, or as a change in the position, of the insert plate 10. Last but not least, the lifting device 11 may also be set such that the insert plate 10 may be set in an oblique or inclined manner relative to a horizontal plane.

An operating state of the sink 1 may be identified and/or a change in the operating state of the sink 1 may be identified and/or an operation of a user who operates the sink 1, in particular at least one functional unit of the sink 1, may be identified by the interaction unit 12. Depending on the identification by the interaction unit 12, the lifting device 11 is able to be operated for automatically changing the position of the insert plate 10. In FIG. 3 a schematic view of a finger 23 of a user is also shown. The interaction unit 12 is preferably configured for detecting a gesture of the user, in particular of the finger 23. In particular, the gesture is a contactless gesture. Additionally or alternatively, however, a direct operation of the operating device 14 may also be carried out with the finger 23. It is provided that an operating state and/or a change in the operating state may be detected by the camera 16 and/or the acoustic unit 17 and/or the operating device 14. An operating state may be, for example, a setting of the operating device 14 and/or a change in the operating state may be a change in the setting of the operating device 14.

A change in the position of the insert plate 10 may be dependent on the type and/or intensity and/or duration of an operating state of at least one functional unit of the sink 1 and/or a change in the position may be dependent on the type and/or intensity and/or duration of a change in an operating state of at least one such functional unit of the sink 1.

The interaction unit 12 has a normal mode. The actual operation of the sink 1 is also detected in this normal mode. Moreover, the interaction unit 12 has a defining mode which is different from the normal mode. This defining mode may be set, for example, by a user. In this defining mode it is possible that at least one user defines or predetermines at least one reference position of the insert plate 10. In particular, in this defining mode such a reference position may be linked with a specific operating state of at least one functional unit of the sink 1 and/or with a defined change in the operating state of at least one functional unit of the sink 1. At least one such reference position may be stored as a user profile in a memory unit 24 of the interaction unit 12.

In an advantageous embodiment it is provided that the surface shown in FIG. 3 (depth direction z and width direction x) of the top 10*a* is at least 80 percent, in particular at least 90 percent, in particular at least 95 percent, of the surface of the receiving area 8 which is viewed in a horizontal plane (in FIG. 3 the plane of the figures). In particular, however, this surface of the top 10*a* is less than 99 percent of this surface of the receiving area 8 in the aforementioned horizontal plane. As a result, it is achieved that a peripheral edge 25 of the insert plate 10 is spaced apart from the lateral walls 4, 5, 6 and 7. In particular, a peripheral gap 26 between the insert plate 10 and the lateral walls 4 to 7 is formed thereby. The gap 26 may be between 3 mm and 15 mm. Preferably, this gap 26 is sufficiently small, at least in the horizontal position of the insert plate 10, that objects such as cutlery or the like are not able to slip through. Moreover, it is thus possible to avoid the situation where a finger 23 is trapped in this horizontal position of the insert plate 10.

As is also shown in FIGS. 1 to 3, the sink 1 has an outlet opening 27, for example a drain. This outlet opening is configured, in particular, in the base wall 3. It is possible for media to drain out of the receiving area 8 from the basin 2 through this outlet opening 27.

Figure 4:
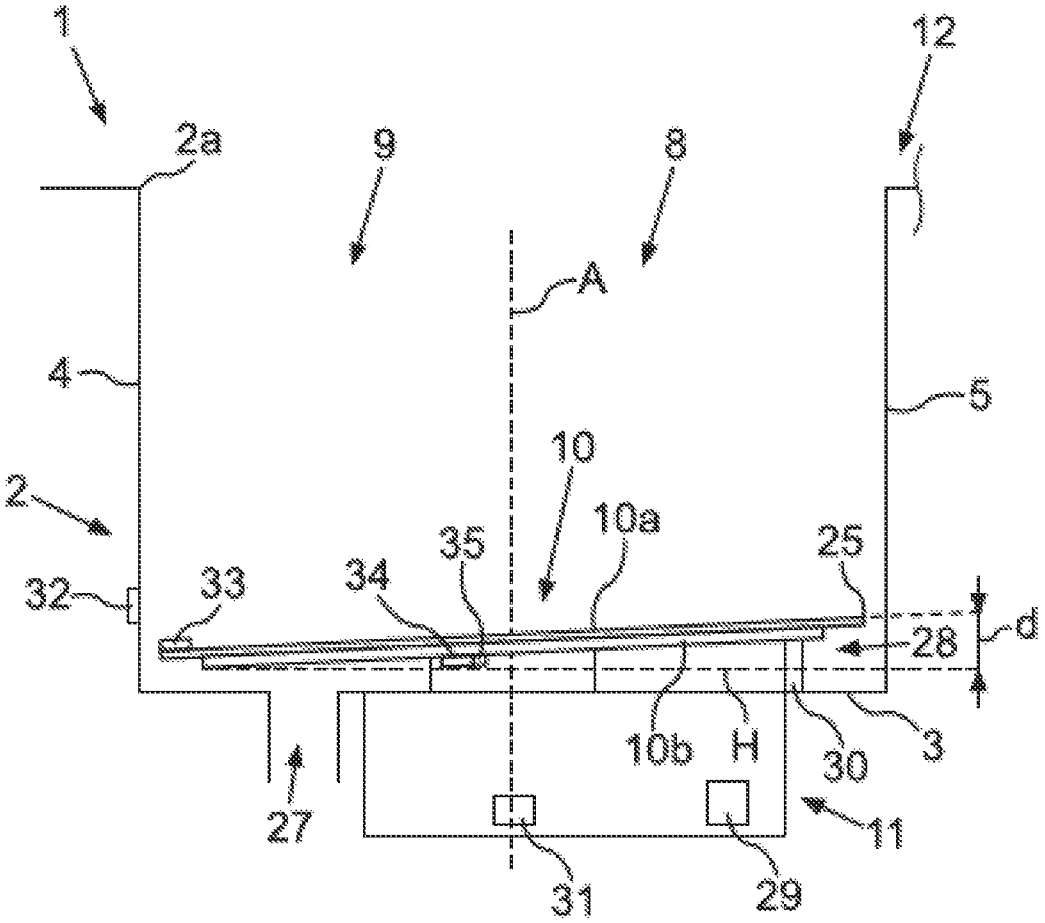
FIG. 4 shows a schematic sectional view through a further exemplary embodiment of a sink according to the invention with an insert plate in a tilted position.

In FIG. 4 a sink 1 with a residual media discharge device 28 is shown in a schematic view. The residual media discharge device 28 is configured for the defined discharge of residual media on the top 10*a* of the insert plate 10. It may be provided that the sink 1 has a control unit 29. The residual media discharge device 28 may be controlled by this control unit 29, in particular in this context it is possible to set a discharge mode of the sink 1 in which the residual media discharge device 28 is activated. In particular, the residual media discharge device 28 may be an electromechanical device.

In the exemplary embodiment shown in FIG. 4, the residual media discharge device 28 is configured to tilt the insert plate 10 relative to a horizontal plane. In this context, the residual media discharge-tilted position of the insert plate 10 is shown in FIG. 4. In particular, this is a tilted position which involves a relatively small lift relative to the horizontal position H. The horizontal position H is illustrated here in dashed lines. In particular, a height difference d of an edge 25 of the insert plate 10 between the horizontal position and the residual media discharge-tilted position is 5 mm, in particular is between 2.5 mm and 4 mm.

In particular, the residual media discharge device 28 has a movement unit 30 for carrying out such a tilting movement of the insert plate 10.

Additionally or alternatively, it may be provided that the residual media discharge device 28 has a rotational unit 31 for the defined discharge of residual media from the top 10*a* of the insert plate 10. This may be a component of the movement unit 30 or a unit which is separate therefrom. The insert plate 10 may be rotated about the axis A by this rotational unit 31. This may also be carried out, in particular, in a discharge mode. Both the movement unit 30 and the rotational unit 31 may be controlled via the control unit 29.

Additionally or alternatively, it may be provided that the sink 1, in particular the residual media discharge device 28, has an airflow generation unit 32. This is to be understood merely symbolically by the box in FIG. 4, both in terms of the position and the embodiment thereof. An airflow may be generated in a targeted manner by this airflow generation unit 32 and directed in order to flow onto the top 10*a* of the insert plate 10. Thus residual media may be blown off the top 10*a*.

Additionally or alternatively, it may also be provided that the residual media discharge device 28 has a slide 33. This slide may be positioned directly on the top 10*a* and displaced or rotated relative to the top 10*a*. In particular, a motor, not shown, may be provided therefor. Thus the slide 33 may also be controlled, in particular, via the control unit 29.

Additionally or alternatively, it may also be provided that the residual media discharge device 28 has a movable flap or a slide. This slide may be opened or closed for releasing or blocking a discharge conduit which is configured in the insert plate 10. The discharge conduit may be a channel which is open toward the top 10*a* and which runs, in particular, toward the edge 25. This discharge conduit, however, may also have a through-hole of the insert plate 10 as a terminal piece terminating before the edge 25. It may also be provided that the discharge conduit, when viewed in terms of its length, is not an upwardly open channel but a duct which is closed toward the top 10*a*. This embodiment is thus configured such that a start of the discharge conduit is open toward the top 10*a* and otherwise this discharge conduit is closed toward the top 10*a*. Thus a duct which is virtually integrated and internal in the insert plate 10 is formed. This duct may lead to the edge 25 at its opposing end and have the outlet there. However, additionally or alternatively, it may also be provided that the duct has an opening toward the bottom 10*b* spaced apart from the edge 25.

Additionally or alternatively, it may be provided that the residual media discharge device 28 has a vibration unit 34. The insert plate 10 may be set in vibration by this vibration unit 34, which may be controlled in particular via the control unit 29, in order to discharge residual media from the top 10*a*.

Additionally or alternatively, it may be provided that the residual media discharge device 28 has a deformation unit 35. The top 10*a* of the insert plate 10 may be deformed thereby in a temporarily defined manner for the discharge of residual media. This deformation unit 35 may be, for example, a bar which presses from below onto the insert plate 10. This insert plate may then be deformed as a symmetrical or asymmetrical dome. This deformation unit 35, however, may also act in a manner which pulls downwardly, so that the top 10*a* is deformed as a funnel or as a channel. For example, instead of a bar, the deformation unit 35 may be configured as a pressure punch or suction punch.

A dismantling mode which is different from the normal mode of the lifting unit of the lifting device 11 may also be set. In this dismantling mode, the lifting unit is set in an even higher position in the vertical direction above the maximum lifted position of the lifting unit in normal mode and thus also the corresponding position of the insert plate 10. In the maximum lifted position in normal mode, in particular, it is provided that the top 10*a* of the insert plate 10 is flush with the top of the upper edge 2*a* of the basin 2 or a decorative frame or a mounting frame. In the dismantling position, which is higher for this purpose, the insert plate 10 is preferably positioned such that it is arranged with its bottom 10*b* higher than this upper edge 2*a* by a vertical spacing. In particular, this vertical spacing is at least 2 cm, in particular at least 3 cm. As a result, the insert plate 10 may be gripped by a hand on its edge 25 and securely held for removal from the lifting unit. The dismantling position is, in particular, a horizontal position of the insert plate 10. The bottom 10*b* of the insert plate 10 is thus positioned entirely above the upper edge 2*a*.

The invention claimed is:

1. A sink, comprising:

a basin including a base wall and lateral walls adjoining the base wall, said basin including a receiving area delimited by the base wall and the lateral walls;

an insert plate separate from the basin and inserted into the receiving area;

a lifting device configured to move the insert plate relative to the basin; and a residual media discharge device configured to discharge residual media from a top of the insert plate, wherein the residual media discharge device includes a movement unit configured to move the insert plate in a defined manner for discharge of residual media from a top surface of the insert plate, and wherein a movement of the insert plate as initiated by the movement unit for discharge of residual media includes a tilting movement of the insert plate relative to a horizontal plane and/or a rotation about a vertical axis.

2. The sink of claim 1, wherein the movement of the insert plate as initiated by the movement unit for discharge of residual media from the top surface of the insert plate includes one of the tilting movement of the insert plate relative to the horizontal plane and the rotation of the insert plate about the vertical axis followed by the other of the tilting movement of the insert plate relative to the horizontal plane and the rotation of the insert plate about the vertical axis.

3. The sink of claim 1, wherein the movement of the insert plate as initiated by the movement unit for discharge of residual media from the top surface of the insert plate includes the tilting movement of the insert plate relative to the horizontal plane at a same time as the rotation of the insert plate about the vertical axis.

4. The sink of claim 1, wherein the residual media discharge device includes an airflow generation unit to generate an airflow for flowing onto the top of the insert plate.

5. The sink of claim 1, wherein the residual media discharge device includes a movable flap or a slide to release or block a discharge conduit in the insert plate for discharge of residual media from the top via the discharge conduit.

6. The sink of claim 1, wherein the residual media discharge device includes a vibration unit to set the insert plate in vibration.

7. The sink of claim 1, wherein the residual media discharge device is an electromechanical device.

8. The sink of claim 1, wherein the top of the insert plate has a surface which is at least 80% of a surface of the receiving area in a horizontal plane but less than 99% of the surface of the receiving area.

9. The sink of claim 1, wherein the top of the insert plate has a surface which is at least 90% of a surface of the receiving area in a horizontal plane but less than 99% of the surface of the receiving area.

10. The sink of claim 1, wherein the top of the insert plate has a surface which is at least 95% of a surface of the receiving area in a horizontal plane but less than 99% of the surface of the receiving area.

11. The sink of claim 1, wherein the lifting device is configured to move the insert plate relative to the basin in a vertical direction to arrange the insert unit at a plurality of different vertical positions, and wherein the plurality of different vertical height positions includes a position wherein a top of the insert plate is in a horizontal position and is flush with a top of the basin.

12. The sink of claim 1, wherein the lifting device is configured to move the insert plate relative to the basin in a vertical direction to arrange the insert unit at a plurality of different vertical positions, and wherein the plurality of different vertical height positions includes a position wherein the insert plate is in a horizontal position and a bottom of the insert plate is spaced entirely above a top of the basin.

13. A sink, comprising:

a basin including a base wall and lateral walls adjoining the base wall, said basin including a receiving area delimited by the base wall and the lateral walls;

an insert plate separate from the basin and inserted into the receiving area;

a lifting device configured to move the insert plate relative to the basin; and a residual media discharge device configured to discharge residual media from a top of the insert plate, wherein the residual media discharge device includes a slide which is slidable over the top of the insert plate for discharge of residual media.

14. The sink of claim 13, further comprising a motor operably connected to the slide for slidably driving the slide.

15. The sink of claim 13, wherein the residual media discharge device includes a movement unit to move the insert plate in a defined manner for discharge of residual media, and wherein a movement of the insert plate as initiated by the movement unit for discharge of residual media is a tilting movement of the insert plate relative to a horizontal plane and/or a rotation about a vertical axis.

16. The sink of claim 13, wherein the residual media discharge device includes a vibration unit to set the insert plate in vibration for discharge of residual media from a top surface of the insert plate.

17. A sink, comprising:

a basin including a base wall and lateral walls adjoining the base wall, said basin including a receiving area delimited by the base wall and the lateral walls;

an insert plate separate from the basin and inserted into the receiving area;

a lifting device configured to move the insert plate relative to the basin; and a residual media discharge device configured to discharge residual media from a top of the insert plate, wherein the residual media discharge device includes a deformation unit to deform the top of the insert plate in a temporarily defined manner for discharge of residual media.

18. The sink of claim 17, wherein the deformation unit includes a movable punch which acts on the insert plate.

19. The sink of claim 17, wherein the residual media discharge device includes a movement unit to move the insert plate in a defined manner for discharge of residual media, and wherein a movement of the insert plate as initiated by the movement unit for discharge of residual media is a tilting movement of the insert plate relative to a horizontal plane and/or a rotation about a vertical axis.

20. The sink of claim 17, wherein the residual media discharge device includes a vibration unit to set the insert plate in vibration for discharge of residual media from a top surface of the insert plate.

* * * * *